US011479400B2

(12) United States Patent
Tsuchiya

(10) Patent No.: US 11,479,400 B2
(45) Date of Patent: Oct. 25, 2022

(54) CONTAINER

(71) Applicant: NISSEI ASB MACHINE CO., LTD., Nagano (JP)

(72) Inventor: Yoichi Tsuchiya, Nagano (JP)

(73) Assignee: NISSEI ASB MACHINE CO., LTD., Nagano (JP)

( * ) Notice: Subject to any disclaimer, the term of this patent is extended or adjusted under 35 U.S.C. 154(b) by 114 days.

(21) Appl. No.: 16/962,458

(22) PCT Filed: Jan. 18, 2019

(86) PCT No.: PCT/JP2019/001527
§ 371 (c)(1),
(2) Date: Jul. 15, 2020

(87) PCT Pub. No.: WO2019/142922
PCT Pub. Date: Jul. 25, 2019

(65) Prior Publication Data

US 2021/0070521 A1 Mar. 11, 2021

(30) Foreign Application Priority Data

Jan. 18, 2018 (JP) ..... JP2018-006662

(51) Int. Cl.
*B65D 79/00* (2006.01)
*B65D 1/02* (2006.01)

(52) U.S. Cl.
CPC ..... *B65D 79/0081* (2020.05); *B65D 1/0276* (2013.01); *B65D 2501/0036* (2013.01)

(58) Field of Classification Search
CPC ..... B65D 79/0081; B65D 1/0276
See application file for complete search history.

(56) References Cited

U.S. PATENT DOCUMENTS 5,217,737 A 6/1993 Gygax et al.
5,593,063 A * 1/1997 Claydon ..... B65D 79/0081 220/608

(Continued)

FOREIGN PATENT DOCUMENTS

CN 103492273 A 1/2014
CN 103492274 A 1/2014

(Continued)

OTHER PUBLICATIONS

Written Opinion of the International Searching Authority issued in International Patent. Application No. PCT/JP2019/001527, dated Feb. 26, 2019, along with English Translation thereof.

(Continued)

*Primary Examiner* — James N Smalley
*Assistant Examiner* — Jennifer Castriotta
(74) *Attorney, Agent, or Firm* — Greenblum & Bernstein, P.L.C.

(57) ABSTRACT

A bottom section has a ground contact section which is provided at the outer periphery of a body section, and a raised bottom section which is provided inside the ground contact section. The raised bottom section is provided with a recessed section provided at the center, and a connection section which connects the recessed section and the ground contact section. The recessed section side end of the connection section is configured to be located closer to the neck side than the ground contact section side end when inner pressure is at ambient pressure.

7 Claims, 6 Drawing Sheets

(56) References Cited

U.S. PATENT DOCUMENTS

| | | | | |
|---|---|---|---|---|
| 6,585,123 | B1 * | 7/2003 | Pedmo | B65D 1/0276 206/509 |
| 8,276,774 | B2 * | 10/2012 | Patcheak | B65D 1/0276 215/373 |
| 8,590,729 | B2 * | 11/2013 | Kamineni | B65D 1/0207 220/609 |
| 9,227,759 | B2 * | 1/2016 | Kurihara | B65D 79/0081 |
| 10,099,811 | B2 * | 10/2018 | Suzuki | B29C 49/08 |
| 2010/0163513 | A1 * | 7/2010 | Pedmo | B65D 79/005 215/370 |
| 2011/0233166 | A1 | 9/2011 | Hiromichi et al. | |
| 2012/0248059 | A1 | 10/2012 | Saito et al. | |
| 2012/0248060 | A1 | 10/2012 | Saito et al. | |
| 2013/0240477 | A1 | 9/2013 | Saito et al. | |
| 2014/0034659 | A1 | 2/2014 | Nakayama | |
| 2014/0124473 | A1 | 5/2014 | Nakayama et al. | |
| 2016/0167824 | A1 * | 6/2016 | Wright | B65D 1/0276 215/376 |
| 2017/0057724 | A1 * | 3/2017 | Bates | B65D 1/0276 |
| 2018/0273271 | A1 * | 9/2018 | Usami | B65D 1/0261 |

FOREIGN PATENT DOCUMENTS

| | | | |
|---|---|---|---|
| JP | 06 500979 | A | 2/1994 |
| JP | 2000 203550 | A | 7/2000 |
| JP | 2007 290772 | A | 11/2007 |
| JP | 2010-275007 | A | 12/2010 |
| JP | 2012-071841 | A | 4/2012 |
| JP | 5316940 | B2 | 10/2013 |
| JP | 2015 205726 | A | 11/2015 |
| JP | 2017 105511 | A | 6/2017 |

OTHER PUBLICATIONS

International Search Report issued in International Patent Application. No. PCT/JP2019/001527, dated Feb. 26, 2019, along with English translation thereof.

Office Action issued in Chinse Patent Application No. 201980017142.X dated Jul. 15, 2021, along with English Translation thereof.

* cited by examiner

[FIG.1]
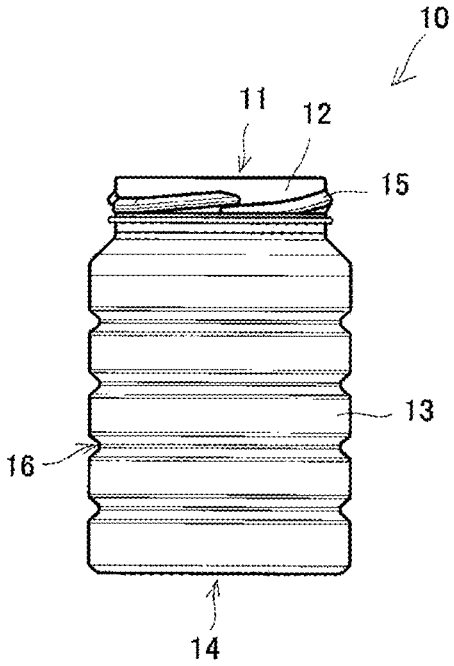

[FIG.2]
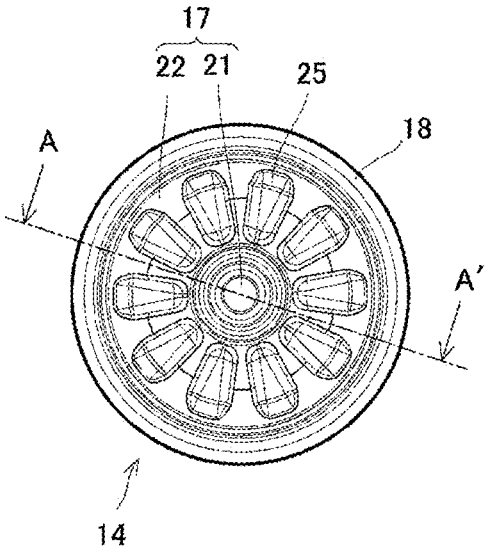

[FIG.3]
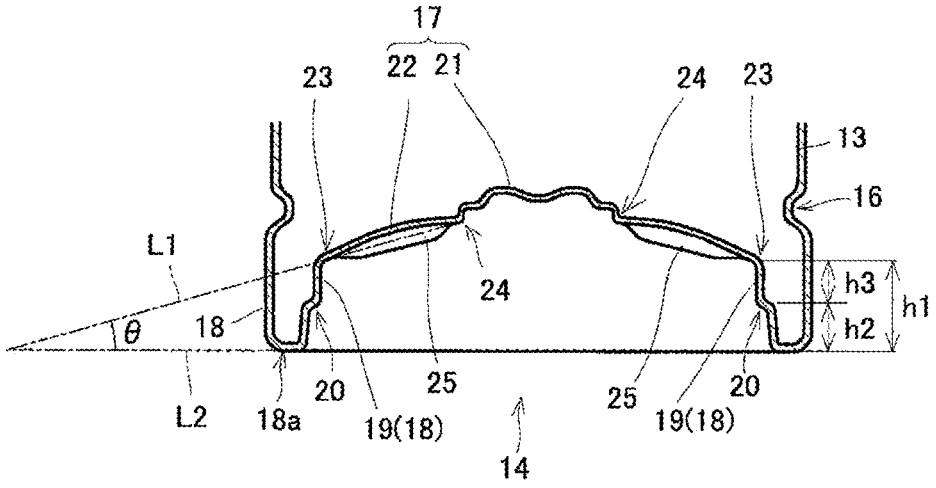
A–A′

[FIG.4]
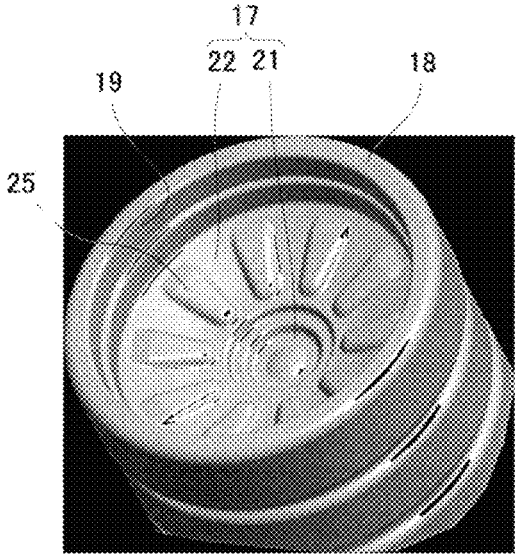

[FIG.5]
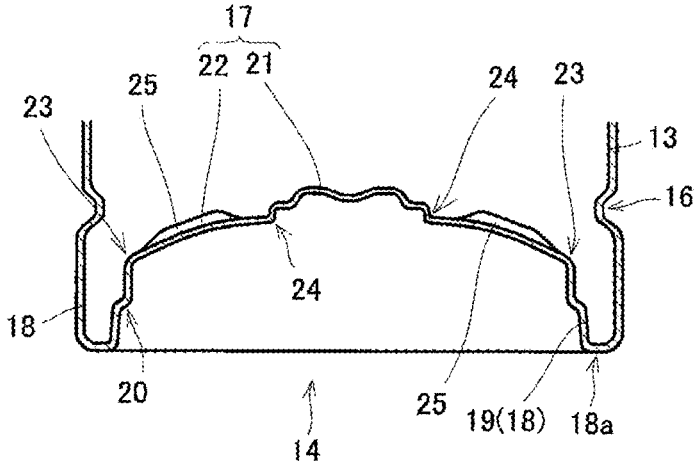

[FIG.6]
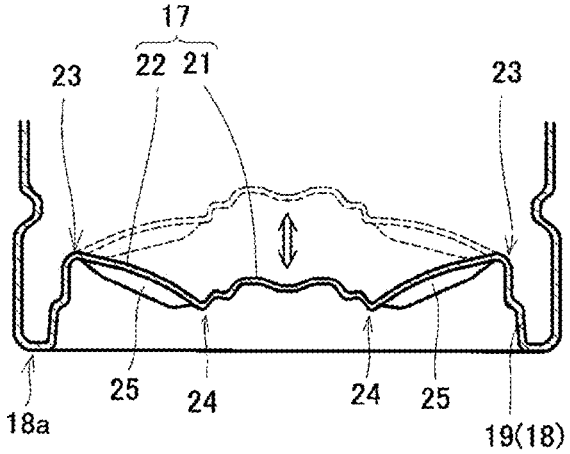

CONTAINER

TECHNICAL FIELD

The present invention relates to a resin-made container having heat resistance.

BACKGROUND ART

Blow-molded containers obtained by using polyethylene terephthalate (PET) as a resin are known. PET containers are excellent in transparency, toughness, hygiene, or the like, and are used as containers for various contents. In particular, the PET containers are widely used at present as containers for storing liquid substances such as beverages. Recently, the uses of the PET containers have been expanded further, and wide-mouthed containers for storing semi-solids such as jam and pasta sauce have begun to appear. A heat-resistant container which is one of the PET containers can be filled with these foods and beverages that have been heated to a high temperature for sterilization.

This type of container is filled with contents that have been heated to a high temperature (for example, about 90° C.) for heat sterilization, sealed with a lid, and then cooled. During the cooling, an inside of the bottle is brought into a reduced-pressure atmosphere as a volume of the contents or a gas remaining or in a space (head space) closer to a mouth portion formed above the contents decreases. At this time, the container may be deformed due to the reduced pressure inside the container, which is not preferred in appearance. Therefore, a container is provided to have a structure on a bottom surface thereof for absorbing deformation due to the reduced pressure inside the container.

For example, a synthetic resin bottle includes a recessed portion on a bottom surface of a bottom portion thereof, and the recessed portion is formed by recessing a bottom surface wall in an inward direction of the bottle such that the bottle can be deformed in the inward direction during pressure reduction (see Patent Literature 1).

CITATION LIST

Patent Literature

Patent Literature 1: Japanese Patent No. 5316940

SUMMARY OF INVENTION

Technical Problem

Some contents with which the container is filled are not suitable for filling at a high temperature as described above. For example, in a case where the content is food such as pickles, the quality of the content may deteriorate when the content itself is subjected to high-temperature sterilization before filling.

It is possible to prevent the quality of the content from deteriorating by, for example, filling the container with the content before the high-temperature sterilization, sealing the container, and then subjecting the content together with the container to the high-temperature sterilization under a predetermined condition.

However, when the content together with the container is subjected to the high-temperature sterilization in this way, the internal pressure of the container may change (rise) as the temperature of the content increases, and the container (for example, a body portion) may be deformed.

The container (bottle) described in Patent Literature 1 can cause the bottle to be recessed and deformed in the inward direction during the pressure reduction, but the deformation of the bottle (container) during pressurization (when the internal pressure rises) is not considered.

The present invention has been made in view of the above circumstances, and an object thereof is to provide a container capable of preventing deformation of a body portion due to a change (for example, rise) in internal pressure and maintaining an aesthetic appearance.

Solution to Problem

An aspect of the present invention for solving the above problem relates to a resin-made container including: a neck portion having an opening; a tubular body portion; and a bottom portion sealing one end side of the body portion, in which the bottom portion includes: a ground contact portion provided on an outer circumferential portion of the body portion; and a raised bottom portion provided on an inner side of the ground contact portion, the raised bottom portion includes: a recessed portion provided in a central portion of the raised bottom portion; and a connection portion connecting the recessed portion and the ground contact portion, and in a state where an internal pressure is normal pressure, an end portion of the connection portion which is adjacent to the recessed portion is located closer to the neck portion than an end portion of the connection portion which is adjacent to the ground contact portion.

Here, it is preferable that a rising portion forming an inner surface of the ground contact portion is provided with a step portion extending in a direction intersecting the body portion, the step portion being continuously provided over a circumferential direction.

In addition, a ratio of a height of the ground contact portion to a diameter of the raised bottom portion is preferably in a range of 0.09 to 0.25

In addition, it is preferable that, the raised bottom portion is formed such that, when filling the container with a content, sealing the opening, and performing high-temperature sterilization at a predetermined temperature, a first corner portion formed by the connection portion and the ground contact portion is bent and displaced toward an outer side of the body portion as the internal pressure rises. Further, it is preferable that the raised bottom portion is formed such that a second corner portion formed by the connection portion and the recessed portion is bent as the first corner portion is bent.

Advantageous Effects of Invention

In such a container according to the present invention, when the internal pressure changes (for example, rises), the raised bottom portion including the connection portion is deformed. Accordingly, the change in internal pressure is prevented, and thus, the deformation of the body portion is prevented. For example, when the content together with the container is subjected to the high-temperature sterilization, the internal pressure of the container changes (rises) as the temperature of the content increases, but even at this time, the deformation of the body portion due to the change (rise) in internal pressure can be effectively prevented.

BRIEF DESCRIPTION OF DRAWINGS

FIG. 1 is a front view of a container according to an embodiment of the present invention.

FIG. 2 is a bottom view of the container according to the embodiment of the present invention.

FIG. 3 is a cross-sectional view showing a bottom portion of the container according to the embodiment of the present invention.

FIG. 4 is a perspective view showing the bottom portion of the container according to the embodiment of the present invention.

FIG. 5 is a cross-sectional view showing another example of the bottom portion of the container according to the embodiment of the present invention.

FIG. 6 is a diagram showing deformation of the bottom portion of the container according to the embodiment of the present invention.

DESCRIPTION OF EMBODIMENTS

Hereinafter, an embodiment of the present invention will be described in detail with reference to FIG. 1 to FIG. 6. A shape of a container shown in FIG. 1 to FIG. 5 corresponds to an initial shape at a time before an internal pressure change (at a time of blow molding or at a time when the internal pressure of the container is normal pressure) or a final shape at a time when the internal pressure change is completed (at a time when the container is sealed and the internal pressure is negative).

As shown in FIG. 1 and FIG. 2, a container (heat-resistant container) 10 according to the present embodiment includes a tubular neck portion 12 having a wide opening 11 on one end side (upper end side), a tubular body portion 13 connected to the neck portion 12, and a bottom portion 14 continuous from the body portion 13. The container 10 is a container made of a resin such as polyethylene terephthalate (PET), and is filled with food such as pickles (including liquid) as a content. A size of the container 10 is not particularly limited, and in the present embodiment, a diameter of the body portion 13 is formed to be about 70 mm.

The neck portion 12 is formed with a screw portion 15 into which a cap (not shown) is screwed. The body portion 13 is provided with a plurality of (for example, four) recessed ribs 16 continuous over a circumferential direction along a height direction of the body portion 13, and accordingly rigidity of the body portion 13 is enhanced.

The container 10 is formed by biaxially stretching and blowing a preform. That is, the container 10 is formed by biaxially stretching and blowing portions other than the neck portion 12. The portions of the container 10 other than the neck portion 12 are imparted with high heat resistance by crystallization by heat setting and an action of removing internal stress. In addition, it is desirable that the neck portion 12 is also white-crystallized and imparted with heat resistance.

As shown in FIG. 2 to FIG. 4, the bottom portion 14 sealing the bottom of the body portion 13 includes a raised bottom portion 17 recessed toward an inner side of the body portion 13 (neck portion 12 side, upper side), and a ground contact portion 18 provided on an outer circumferential portion of the raised bottom portion 17. That is, the raised bottom portion 17 seals a center of the body portion 13 with respect to a rising portion 19 forming an inner surface of the ground contact portion 18. The ground contact portion 18 is a portion where the container 10 with the opening 11 facing upward is in contact with a table when, for example, placing the container 10 on the table. In the present embodiment, the ground contact portion 18 is on an outer side of the rising portion 19 and is slightly thicker than the raised bottom portion 17.

In addition, in the present embodiment, near a center of the rising portion 19 in the height direction, a step portion 20 extending in a direction intersecting the body portion 13 (for example, a direction substantially parallel to the raised bottom portion 17) is continuously provided over the circumferential direction. Accordingly, an end portion of the rising portion 19 on an upper side (which is adjacent to the raised bottom portion 17) is located closer to a center of the bottom portion 14 than an end portion of the rising portion 19 on a lower side.

Since the step portion 20 is provided, a thickness of the ground contact portion 18 (particularly the rising portion 19) can be prevented from being thin when producing the container 10 by molding. That is, a decrease in rigidity of the ground contact portion 18 can be prevented. Further, since the portion of the rising portion 19 which is adjacent to the raised bottom portion 17 (upper side) with respect to the step portion 20 has a protruded rib shape protruding toward the inner side from the bottom side (lower side), a reinforcing function is provided. Therefore, the rising portion 19 provided with the step portion 20 has rigidity higher than that of a case where the step portion 20 is not provided.

In addition, the raised bottom portion 17 includes a recessed portion 21 whose central portion is recessed toward the inner side (neck portion 12 side, upper side), and a connection portion (bottom portion movable surface) 22 connecting the recessed portion 21 and the rising portion 19. As will be described later in detail, this connection portion (bottom portion movable surface) 22 can be deformed (displaced) together with a change (in particular, rise) in internal pressure of the container 10.

The connection portion 22 is provided to incline from the rising portion 19 over the recessed portion 21 toward the inner side of the body portion 13 (neck portion 12 side, upper side). Specifically, in a state where the internal pressure of the container 10 is normal pressure, the connection portion 22 is formed such that an end portion of the connection portion 22 which is adjacent to a recessed portion 21 is located closer to the neck portion 12 (closer to the inner side of the body portion 13, upper side in FIG. 3) than an end portion of the connection portion 22 which is adjacent to the ground contact portion 18.

That is, in a state where the internal pressure of the container 10 is normal pressure (substantially atmospheric pressure), a second corner portion 24 formed by the connection portion 22 and the recessed portion 21 is located closer to the inner side of the body portion 13 (neck portion 12 side: the upper side in FIG. 3) than a first corner portion 23 formed by the connection portion 22 and the rising portion 19. For example, as shown in the cross-sectional view in FIG. 3, the connection portion 22 is formed such that an angle θ formed by a straight line L1 connecting the first corner portion 23 and the second corner portion 24 and a straight line L2 extending from a ground contact surface 18*a* of the ground contact portion 18 is an acute angle.

In addition, in the present embodiment, the connection portion 22 is provided with a plurality of reinforcing ribs 25 extending radially from the recessed portion 21 side toward the ground contact portion 18 side, and accordingly the rigidity of the connection portion 22 is enhanced. These reinforcing ribs 25 are provided on the connection portion 22 to protrude toward the outer side (lower side) of the body portion 13 (container 10). A protruding amount of the reinforcing rib 25 is larger toward a center of the raised bottom portion 17. Further, a width of the reinforcing rib 25 is narrower toward the center of the raised bottom portion 17.

In addition, the reinforcing rib 25 is provided with a length that does not reach the first corner portion 23 and the second corner portion 24. That is, the reinforcing rib 25 is not provided near the first corner portion 23 and the second corner portion 24. Therefore, the rigidity of the first corner portion 23 and the second corner portion 24 is relatively slightly lower than that of the connection portion 22 provided with the reinforcing ribs 25.

When such reinforcing ribs 25 are provided on the connection portion 22, the connection portion 22 is more appropriately deformed (displaced) according to the change in internal pressure of the container 10, and it is easy to prevent the change (rise) in internal pressure of the container 10 as described later. The shape and size of the reinforcing rib 25 are not particularly limited, and may be appropriately determined to make the connection portion 22 have desired rigidity.

In the present embodiment, the reinforcing rib 25 has a shape protruding toward the outer side (lower side) of the body portion 13, but may have a shape (recessed shape) protruding toward the inner side (upper side) of the body portion 13 as shown in FIG. 5, for example. In the example shown in FIG. 5, the protruding amount of the reinforcing rib 25 is also larger toward the center of the raised bottom portion 17. In addition, the width of the reinforcing rib 25 is also narrower toward the center of the raised bottom portion 17. Further, the reinforcing rib 25 is also provided with a length that does not reach the first corner portion 23 and the second corner portion 24.

According to the configuration of the container 10 of the present embodiment described above, when the internal pressure changes (for example, rises), it is possible to prevent the deformation of the body portion 13 and to maintain the aesthetic appearance. Further, bulging deformation and irregular deformation of the raised bottom portion 17 due to the change (rise) in internal pressure can also be prevented. The bulging deformation includes inversion deformation, buckling, and irreversible deformation that the raised bottom portion 17 or the rising portion 19 bulges toward the outer side (lower side) from the ground contact portion 18 when the internal pressure rises and does not return to the original shape when the internal pressure drops.

Specifically, when the internal pressure of the container 10 rises, the raised bottom portion 17 of the bottom portion 14 selectively responds to the rise in internal pressure and is deformed (displaced) to protrude toward the outer side (lower side). The deformation (displacement) of the raised bottom portion 17 prevents (absorbs) the rise in internal pressure. Therefore, even when the internal pressure of the container 10 rises, undesired deformation of the body portion 13 can be prevented.

Here, the height of the rising portion 19 forming the ground contact portion 18 is not particularly limited, and is preferably set as low as possible in order to ensure the rigidity of the raised bottom portion 17 when the internal pressure of the container 10 rises. That is, when the internal pressure of the container 10 rises, the height of the rising portion 19 is preferably set low enough to sufficiently deform the first corner portion 23.

For example, in the present embodiment, a diameter D of the raised bottom portion 17 is about 56 mm to 66 mm. In this case, a height (vertical length) h1 of the rising portion 19 (see FIG. 3) is preferably in a range of 6 mm to 14 mm. A ratio of the height (vertical length) h1 of the rising portion 19 to the diameter D of the raised bottom portion 17 is in a range of 0.09 to 0.25, and preferably 0.17 to 0.20.

Further, when single step portion 20 is provided on the rising portion 19 as in the present embodiment, a height (vertical length) h2 from a lower end portion 19*g* of the rising portion 19 to the step portion 20 is preferably in a range of 3 mm to 7 mm, and a height (vertical length) h3 from the step portion 20 to an upper end portion 19*a* is preferably in a range of 3 mm to 7 mm. It is preferable that a ratio of the heights h1, h2 and h3 is about 2:1:1. In addition, it is preferable that a ratio of the heights h1 and h2 can be appropriately set in a range of 3:7 to 7:3, and particularly a range of 0.5:1 to 1:1 or 1:0.5 to 1:1.

When the bottom 14 is formed with such dimensions, the rigidity of the raised bottom portion 17 can be ensured, and the raised bottom portion 17 can be more appropriately deformed (displaced) as the internal pressure of the container 10 changes (rises).

Next, with reference to FIG. 6, a deformed state of the raised bottom portion 17 due to the change (rise) in internal pressure of the container 10 will be described in more detail.

For example, when filling the container 10 with the contents of food such as pickles (including liquid), the container 10 is filled with the contents whose temperature is controlled at about 10° C. to 40° C. and the opening 11 is sealed with a cap (not shown) in order to prevent quality deterioration. Thereafter, the container 10 may be heated with a high temperature medium of about 85° C. to 95° C. for a predetermined time (about 30 minutes) to sterilize the contents and the inside of the container 10 (including an inner surface region of the cap). When the sterilization treatment is performed at such a high temperature, the volume of the contents or air in the head space may increase as the temperature increases, and the pressure in the container 10 may change (rise) (the pressure in the container 10 may be higher than the atmospheric pressure outside the container 10).

When the internal pressure of the container 10 changes (rises), as shown in FIG. 6, the first corner portion 23 bends and the connection portion 22 deforms (falls) toward the outer side of the container 10. The connection portion 22 is displaced toward the outer side (bottom side) of the container 10 mainly from the first corner portion 23 as a base point without being substantially deformed since the reinforcing ribs 25 are provided. In addition, the second corner portion 24 is also bent as the connection portion 22 moves. Therefore, the recessed portion 21 also moves toward the outer side of the container 10 without being largely deformed. That is, when the internal pressure of the container 10 rises, the raised bottom portion 17 moves (displaces) toward the outer side of the container 10 with the first corner portion 23 as a base point.

Accordingly, the rise in internal pressure of the container 10 is prevented (preferably absorbed). Therefore, undesired deformation of the body portion 13 can be prevented. Further, bulging deformation (inversion deformation) and irregular deformation of the raised bottom portion 17 due to the change in internal pressure can be prevented. In addition, since the rigidity of the rising portion 19 is enhanced by the step portion 20, the bulging deformation (buckling) of the raised bottom portion 17 due to the change (rise) in internal pressure can be effectively prevented.

As described above, the connection portion 22 forming the raised bottom portion 17 is provided to be inclined from the rising portion 19 toward the inner side of the body portion 13 (neck portion 12 side). That is, in a state where the internal pressure of the container 10 is normal pressure (substantially atmospheric pressure), the second corner portion 24 formed by the connection portion 22 and the recessed portion 21 is located closer to the inner side of the body portion 13 (neck portion 12 side) than the first corner portion 23 formed by the connection portion 22 and the rising portion 19. Accordingly, the raised bottom portion 17 is easily deformed with the first corner portion 23 as a base point when the internal pressure of the container 10 changes (rises).

Appropriate rigidity of the connection portion 22 is ensured by the reinforcing ribs 25, but the reinforcing ribs 25 are not provided near the first corner portion 23 and the second corner portion 24. Therefore, the first corner portion 23 and the second corner portion 24 are easily deformed as compared with the connection portion 22. In addition, when the internal pressure changes, the reinforcing ribs 25 make it easier to move the connection portion 22 up and down uniformly (wholly and evenly) rather than locally. Therefore, the rise in internal pressure of the container 10 can be absorbed by the local deformation of the raised bottom portion 17 (the up-down movement of the connection portion 22), and the deformation amount of the body portion 13 at this time can be reduced. Thus, the aesthetic appearance of the container 10 can be favorably maintained.

Thereafter, when the high-temperature sterilization for the container 10 and the contents is completed, the container 10 and the contents are cooled to room temperature. As the temperature of the contents decreases, the internal pressure of the container 10 changes again and drops to normal pressure (substantially atmospheric pressure). Then, as the internal pressure drops, the raised bottom portion 17 deforms (rises) to the original position shown by the dotted line in FIG. 6.

Thus, the raised bottom portion 17 of the container 10 according to the present invention has a function capable of suitably responding to the change in internal pressure of the container 10 caused by the high-temperature sterilization treatment after sealing (specifically, a transition in internal pressure that the pressure rises from normal pressure, is maintained at a peak pressure for a predetermined time, and then drops).

Although one embodiment of the present invention is described above, the present invention is not limited to the above embodiment. The present invention can be appropriately modified without departing from the scope of the invention.

For example, in the above embodiment, single step portion 20 is provided in the rising portion 19, but two or more step portions 20 may be provided. That is, the rising portion 19 is formed in two steps in the present embodiment, but may be formed in three steps or more. Further, the step portion 20 is not necessarily provided. The height of the rising portion 19 is also not particularly limited, and may be set to such a height that the raised bottom portion 17 does not protrude beyond the outer side of the ground contact surface 18*a* when the raised bottom portion 17 is deformed.

In addition, for example, in the above embodiment, the case where the internal pressure rises to a positive pressure has been mainly described as the pressure change in the container 10. However, the present invention has the same effect even when the internal pressure drops and becomes negative.

REFERENCE SIGNS LIST

10 container (heat-resistant container)
11 opening
12 neck portion
13 body portion
14 bottom portion
15 screw portion
16 recessed rib
17 raised bottom portion
18 ground contact portion
18*a* ground contact surface
19 rising portion
20 step portion
21 recessed portion
22 connection portion
23 first corner portion
24 second corner portion
25 reinforcing rib

The invention claimed is:

1. A resin-made container comprising:
a neck portion having an opening;
a tubular body portion; and
a bottom portion sealing one end side of the body portion,
wherein the bottom portion includes:
a ground contact portion provided on an outer circumferential portion of the body portion;
a rising portion forming an inner surface of the ground contact portion; and
a raised bottom portion provided on an inner side of the ground contact portion,
wherein the raised bottom portion includes:
a recessed portion provided in a central portion of the raised bottom portion; and
a connection portion connecting the recessed portion and the rising portion,
wherein, in a state where an internal pressure is normal pressure, an end portion of the connection portion which is adjacent to the recessed portion is located closer to the neck portion than an end portion of the connection portion which is adjacent to the rising portion, and
wherein, even when the internal pressure rises, the connection portion is located closer to the neck portion than is an end portion of the rising portion that is adjacent to a ground contact surface.

2. The container according to claim 1, wherein the rising portion forming an inner surface of the ground contact portion is provided with a step portion extending in a direction intersecting the body portion, the step portion being continuously provided over a circumferential direction.

3. The container according to claim 1,
wherein a ratio of a height of the ground contact portion to a diameter of the raised bottom portion is in a range of 0.09 to 0.25.

4. The container according to claim 1,
wherein the raised bottom portion is formed such that, when filling the container with a content, sealing the opening, and performing high-temperature sterilization at a predetermined temperature, a first corner portion formed by the connection portion and the ground contact portion is bent and displaced toward an outer side of the body portion as the internal pressure rises.

5. The container according to claim 4,
wherein the raised bottom portion is formed such that a second corner portion formed by the connection portion and the recessed portion is bent as the first corner portion is bent.

6. The container according to claim 1, wherein, even when the internal pressure rises, the rising portion and the raised portion are located closer to the neck portion than the ground contact surface.

7. The container according to claim 1,
wherein the rising portion is substantially parallel to the tubular body portion.

* * * * *